US006912967B1

(12) United States Patent
Oats et al.

(10) Patent No.: US 6,912,967 B1
(45) Date of Patent: Jul. 5, 2005

(54) HYBRID WATERCRAFT

(76) Inventors: Graham H. Oats, 1511 E. Del Amo, Carson, CA (US) 90746; Sandra K. Oats, 1511 E. Del Amo, Carson, CA (US) 90746

( * ) Notice: Subject to any disclaimer, the term of this patent is extended or adjusted under 35 U.S.C. 154(b) by 20 days.

(21) Appl. No.: 10/621,683

(22) Filed: Jul. 15, 2003

(51) Int. Cl.[7] ..... B63B 1/32

(52) U.S. Cl. ..... 114/288; 114/272; 114/61.1

(58) Field of Search ..... 114/271–273, 288–290, 114/67 A, 61.1, 61.12, 61.13, 61.14, 123; 180/116–130; 244/105, 106; D12/310–312

(56) References Cited

U.S. PATENT DOCUMENTS

| | | | | | |
|---|---|---|---|---|---|
| 2,272,661 | A | | 2/1942 | Finley | |
| D147,036 | S | | 7/1947 | Dix | |
| 2,938,490 | A | | 5/1960 | Martin | |
| D190,698 | S | | 6/1961 | Martindale | |
| 3,077,172 | A | | 2/1963 | Domak | |
| 3,094,962 | A | * | 6/1963 | Goar | 114/271 |
| D197,869 | S | | 3/1964 | Rae | |
| 3,143,097 | A | * | 8/1964 | Meyerhoff | 114/278 |
| 3,216,389 | A | | 11/1965 | Thorsen | |
| 3,288,096 | A | * | 11/1966 | Swenson | 114/273 |
| D215,370 | S | * | 9/1969 | Calkins | D12/311 |
| 3,600,733 | A | | 8/1971 | Lipplach | |
| 3,627,235 | A | * | 12/1971 | Lippisch | 244/12.1 |
| 3,661,111 | A | * | 5/1972 | Lippisch | 114/67 A |
| D235,858 | S | * | 7/1975 | Lyford, III | D12/311 |
| 3,968,763 | A | * | 7/1976 | Mason | 114/67 A |
| D241,927 | S | | 10/1976 | Caferelli | |
| 4,004,542 | A | | 1/1977 | Holmes | |
| D245,973 | S | | 10/1977 | Vasilatos et al. | |
| 4,095,549 | A | * | 6/1978 | Williams | 114/283 |
| 4,237,810 | A | | 12/1980 | Westfall | |
| 4,712,630 | A | * | 12/1987 | Blum | 180/117 |
| 4,781,141 | A | | 11/1988 | Webb | |

(Continued)

FOREIGN PATENT DOCUMENTS

| | | | | | |
|---|---|---|---|---|---|
| EP | 450514 | A1 | * | 10/1991 | B60V/1/22 |
| JP | 01078965 | A | * | 3/1989 | B60V/1/08 |
| JP | 01244957 | A | * | 9/1989 | B60V/1/08 |
| JP | 03159865 | A | * | 7/1991 | B60V/1/08 |
| JP | 405228224 | A | | 9/1993 | |
| JP | 06107294 | A | * | 4/1994 | B64C/35/02 |
| JP | 11011376 | A | * | 1/1999 | B63B/1/18 |
| JP | 411171094 | A | | 6/1999 | |
| JP | 11263217 | A | * | 9/1999 | B60V/3/08 |

*Primary Examiner*—S. Joseph Morano
*Assistant Examiner*—Ajay Vasudeva
(74) *Attorney, Agent, or Firm*—Roy L Anderson

(57) ABSTRACT

A watercraft steered under power by water-jet propulsion utilizes a water intake ramp in its hull to create a nozzle-like effect to accelerate water loading to the jet pump through a ventral water inlet when under power. The hull has a pair of longitudinal stabilizers that form a tunnel in which the ramp is located. A canopy, which can be removable, encloses a passenger compartment with a steering wheel and one or more passenger seats. Two wings flank the passenger compartment and a pair of hull ramps run steeply downward from the leading edge of each of the wings and extends to the bottom of the hull while a pair of air scoops flanks each side of the passenger compartment and is located above the pair of wings. The forward-most beginnings of the pair of stabilizers relative to a nose section and the pair of wings ride above the surface of the water when the watercraft is under power and the watercraft rides on the back of the pair of stabilizers. The tops of wings are curved in a configuration to give the watercraft top lift and have a reverse curve on their bottom surface relative to the surface of the water to push the hull upward and provide a faster plane for the watercraft to run on the pair of stabilizers. The engine and the driver's passenger seat rest on the center of gravity of the watercraft at the water line when the watercraft is under power.

27 Claims, 8 Drawing Sheets

U.S. PATENT DOCUMENTS

| | | | | | |
|---|---|---|---|---|---|
| 4,862,817 | A | | 9/1989 | Hornsby | |
| 4,926,773 | A | * | 5/1990 | Manor | 114/280 |
| D309,596 | S | * | 7/1990 | Castagna | D12/300 |
| D317,747 | S | * | 6/1991 | Riley | D12/300 |
| D329,419 | S | * | 9/1992 | Thomas et al. | D12/309 |
| 5,231,949 | A | | 8/1993 | Hadley | |
| 5,299,960 | A | | 4/1994 | Day | |
| 5,314,035 | A | * | 5/1994 | Schoell | 180/119 |
| 5,335,742 | A | * | 8/1994 | Blum | 180/117 |
| 5,351,641 | A | | 10/1994 | Robson | |
| 5,351,642 | A | | 10/1994 | Ackerbloom | |
| 5,357,894 | A | * | 10/1994 | Jacobson | 114/272 |
| D357,647 | S | * | 4/1995 | Blum | D12/5 |
| 5,415,365 | A | * | 5/1995 | Ratliff | 244/101 |
| D359,941 | S | | 7/1995 | Mannerfelt | |
| 5,474,014 | A | | 12/1995 | Russell | |
| 5,526,764 | A | * | 6/1996 | Jacobson | 114/272 |
| 5,566,775 | A | * | 10/1996 | Schoell | 180/120 |
| 5,588,388 | A | | 12/1996 | Maruyama | |
| 5,605,110 | A | | 2/1997 | Talbot | |
| 5,611,294 | A | * | 3/1997 | Burg | 114/61.1 |
| D379,451 | S | | 5/1997 | Mannerfelt | |
| 5,711,494 | A | * | 1/1998 | Saiz | 244/12.1 |
| 5,718,184 | A | | 2/1998 | Holland | |
| D407,682 | S | | 4/1999 | Mannerfelt | |
| 5,934,218 | A | | 8/1999 | Chen | |
| 5,983,823 | A | | 11/1999 | Allison | |
| 6,014,940 | A | * | 1/2000 | Jacobson | 114/271 |
| 6,164,591 | A | | 12/2000 | Descatha | |
| 6,305,995 | B1 | | 10/2001 | Staunning | |
| 6,311,635 | B1 | * | 11/2001 | Vaton | 114/272 |
| 6,318,286 | B1 | | 11/2001 | Nakashima | |
| 6,325,011 | B1 | | 12/2001 | Klem | |
| 6,343,964 | B1 | | 2/2002 | Mardikian | |
| 6,409,122 | B1 | | 6/2002 | Nicolai | |
| 6,425,341 | B1 | | 7/2002 | Devin | |
| 2001/0025594 | A1 | | 10/2001 | Daniels | |
| 2001/0035117 | A1 | | 11/2001 | Burg | |

* cited by examiner

HYBRID WATERCRAFT

FIELD OF THE INVENTION

The present invention is in the field of watercraft and, more particularly, in the field of personal watercraft.

BACKGROUND OF THE INVENTION

Vessels that travel on water have been around for thousands of years. Before the advent of modern engines, such vessels were traditionally powered by wind and oars. As more modern means of power were invented, water vessels also began to evolve.

In recent years the field of personal watercraft has taken off and developed into its own significant category. Personal watercraft, like a traditional boat, travel on water. As the name implies, personal watercraft tend to be designed for use by one person, although they are usually capable of handling a few additional riders, and they tend to travel relatively fast on the water. In contrast to "traditional" boats, personal watercraft generally do not have a deck or sitting area inside of a hull that will, for the most part, remain dry. Thus, personal watercraft tend to be ill-suited to certain recreational uses, such as fishing or serving as a means for "dry" transportation over water, even if the ultimate destination might be a spot for swimming or skin or scuba diving. Instead, personal watercrafts tend to be characterized by their ability to travel fast over the surface of the water and thereby offer a certain thrill to the rider. As such, riders of personal watercraft tend to get wet during the ride. While this is fine in warmer climates and during warmer periods of the year in certain locations, it limits the usefulness and enjoyment of such watercraft unless the rider(s) wear appropriate protective clothing, such as a wetsuit. Thus, even if an individual owns one or more personal watercraft, the same individual will likely own or use one or more separate boats if the same individual wants to participate in additional activities, such as family boating, fishing, jet skiing, and the like.

Still, personal watercraft serve a very real need, and they have become so popular that, in 1987, the Personal Watercraft Industry Association ("PWIA") was founded as an affiliate of the National Marine Manufacturers Association, representing five U.S. personal watercraft manufacturers—American Honda Motor Co., Inc., Bombardier Recreational Products, Kawasaki Motors Corp, U.S.A., Polaris Industries Inc. and Yamaha Motor Corp., U.S.A. According to information set forth on the official PWIA website, found at www.pwia.org, the PWIA was formed "to bring together companies that manufacture personal watercraft (PWC) in order to promote safe and responsible operation of personal watercraft and work with federal, state and local agencies which have regulatory responsibilities for recreational boating. PWIA has a simple mission: ensuring that personal watercraft and personal watercraft users are treated fairly when local, state, and federal government officials consider boating regulations. PWIA supports and actively advocates for reasonable regulations, strong enforcement of boating and navigation laws, and mandatory boating safety education for all PWC operators." According to the PWIA, a PWC is defined as follows: "The official definition of a personal watercraft varies from state to state, but they are generally recognized as a vessel which uses an inboard motor powering a water jet pump as its primary source of motive power, and which is designed to be operated by a person sitting, standing, or kneeling on the vessel, rather than the conventional manner of sitting or standing in the vessel."

Obviously, personal watercraft represent a significant market segment for such craft to have their own industry trade association, and the information put out by this organization is useful to provide a better understanding of this industry. According to the PWIA, the following is a history of their industry:

The personal watercraft (PWC) concept originated in the 1960s when a home inventor conceived and built his notion of a powered water ski. This design combined the elements of self-power, small size, and a maneuverable, active ride. Bombardier Recreational Products, known for its Ski-Doo snowmobiles, introduced a craft in the late 1960s with limited success. This craft gets credit for being the first sit-down style PWC. In the early 1970s, Kawasaki Motors Corp. U.S.A. introduced the Jet Ski® watercraft, the first commercially successful PWC.

PWC are considered by the U.S. Coast Guard to be inboard boats under 16 feet in length. They are powered by either a 2-stroke gasoline engine (the same basic engine type which is found in most outboard motors), or by a 4-stroke gasoline engine, the same engine type used in cars. The engine drives a jet pump that draws water from the bottom of the craft into an impeller (a type of propeller fitted into a surrounding "tunnel"), which pressurizes the water and forces it out a nozzle at the rear of the craft. It is this jet of pressurized water that propels and steers the craft when the throttle is engaged. New off-throttle steering technology offers personal watercraft users increased maneuverability when the throttle is disengaged.

There are five major companies currently active in the personal watercraft market. In the mid-1980s, Kawasaki's Jet Ski® watercraft was joined by Yamaha Motor Corp. U.S.A.'s line of WaveRunner® models, which truly began the change in market emphasis from the stand-up style PWC to a sit-down style with one- or two-person capacities. Shortly after, Bombardier Recreational Products re-joined the market with their Sea-Doo® line. In the early 1990s, snowmobile giant Polaris Industries Inc. joined the PWC market, and in 2002 American Honda began selling PWC, the AquaTrax. Along the way, two-person craft quickly took over from the single person style, and today three- and four-person family models are showing the strongest growth. Multiple-person family craft currently make up more than 97 percent of personal watercraft sales.

The first PWC consumer magazines also began to hit the racks in the mid-1980s. *Splash, Personal Watercraft Illustrated, Water Scooter* (*now Watercraft World*), and *PWC Magazine* sang the praises of the new and rapidly growing sport. Growth of the sport was rapid up until the mid-1990s, and what was once a small portion of the recreational motorized consumer product business became the fastest growing sport in this category. At the same time, the PWC industry became the fastest growing segment in the marine business."

However, while the industry has grown very quickly, such growth has not been without its problems. Some of the problems that have faced the industry are noise, pollution and safety concerns. In addition, whether it is due to such concerns, cyclic sales, economic conditions, bad press, changing demographics or clientele, or simple saturation, or a combination of the above, sales of PWC has been in decline for six years. According to the PWIA:

"Sales of PWC peaked in 1995 with approximately 200,000 units sold. Since that time, annual PWC sales have declined significantly. In 1998 there were approximately 130,000 units sold. Sales of PWC have continued to drop in recent years, though they began to level off in 2002 with sales of 79,300."

Still, lest such decline in sales be taken out of context, it is important to realize that overall sales and usage of PWC are still quite large. Once again, according to PWIA:

"According to National Marine Manufacturers Association estimates, there were approximately 1.35 million PWC owned in 2002. The average retail price of a PWC in 2002 was $8,800. Since the mid-1990s, sit-down style, multi-passenger watercraft have made up around 99 percent of all PWC sales, with three- and four-passenger family models the fastest growing segment. Twenty million Americans ride personal watercraft each year."

Accordingly, there is a very strong and real need for improved PWC that address some of the major concerns of the industry, namely, noise, pollution and safety, while still offering a PWC enthusiast what he or she is looking for, including a fun ride. Additionally, there has been a long-felt need for a PWC-like vessel that is more flexible and offers greater flexibility in use than current PWC; in other words, a PWC-like vessel that is useful for activities such as fishing, transportation, and the like. However, for such a vessel to truly meet such a need, it must be easy to transport, like a PWC, and it must not be too expensive. It is this long-felt need that is addressed by the present invention.

SUMMARY OF THE INVENTION

The present invention is generally directed to a watercraft, that is steered under power by water-jet propulsion, having a hull that has a forwardly tapering nose section with a keel that knifes downward from the tip of the nose section, a mid-section passenger compartment formed within the hull with at least one passenger seat and a steering control mechanism, and an aft end-section in which the engine is located. The hull has a pair of stabilizers that run longitudinally and which are spaced apart from each other that form a tunnel. A water intake ramp creates a nozzle-like effect to accelerate water loading to the jet pump through a ventral water inlet when the watercraft is under power. The ventral water inlet is located in, and is narrower than, the intake ramp. The intake ramp tapers downwardly from its forward-most beginning relative to the nose section and is located in the tunnel substantially back from the forward-most beginnings of the pair of stabilizers relative to the nose section. Dual air intakes, one for the engine and another for ventilation, flank the canopy. A pair of wings also flanks the passenger compartment and extends laterally therefrom rearward to join the aft end-section. A pair of hull ramps run steeply downward from the leading edge of each of the pair of wings and extends therefrom to the bottom of the hull while a pair of air scoops flanks each side of the passenger compartment and is located above the pair of wings. The hull, the pair of wings, the pair of hull ramps, and the pair of air scoops are bilaterally symmetric with a center line running through the nose section and the passenger compartment.

In a first, separate group of aspects of the present invention, the forward-most beginnings of the pair of stabilizers relative to the nose section and the pair of wings ride above the surface of the water when the watercraft is under power and the watercraft rides on the pair of stabilizers.

In a second, separate group of aspects of the present invention, the intake ramp is located in the back longitudinal half of the watercraft relative to the nose section, the tops of the pair of wings are curved in a configuration to give the watercraft top lift and the pair of wings have a reverse curve on their bottom surface relative to the surface of the water to push the hull upward and provide a faster plane for the watercraft to run on the pair of stabilizers.

In a third, separate group of aspects of the present invention, the engine and the driver's passenger seat rest on the center of gravity of the watercraft at the water line when the watercraft is under power.

In other, separate aspects of the present invention, at least one accessory rack is mounted to the aft end-section of the watercraft, a pair of headlights can project frontward out of the hull, and a rudder is connected to the jet pump.

In still other, separate aspects of the present invention, a mid-section canopy, that can have a transparent window, is detachable from the watercraft. The mid-section canopy and the hull can totally enclose the passenger compartment which can be configured with either one or more passenger seats, multiple seats being aligned one behind each other.

In yet still other, separate aspects of the present invention, the passenger compartment can be fitted with various electronic accessories and instruments, including a global positioning system with a display mounted within the passenger compartment, a depth finder with a display mounted within the passenger compartment, or an electronic communications device with an input device mounted within the passenger compartment.

In further, separate aspects of the present invention, the watercraft is a personal watercraft with a length of less than sixteen feet.

Accordingly, it is a primary object of the present invention to provide an improved watercraft.

This and further objects and advantages will be apparent to those skilled in the art in connection with the drawings and the detailed description of the preferred embodiment set forth below.

DETAILED DESCRIPTION OF THE PREFERRED EMBODIMENTS

Figure 1:
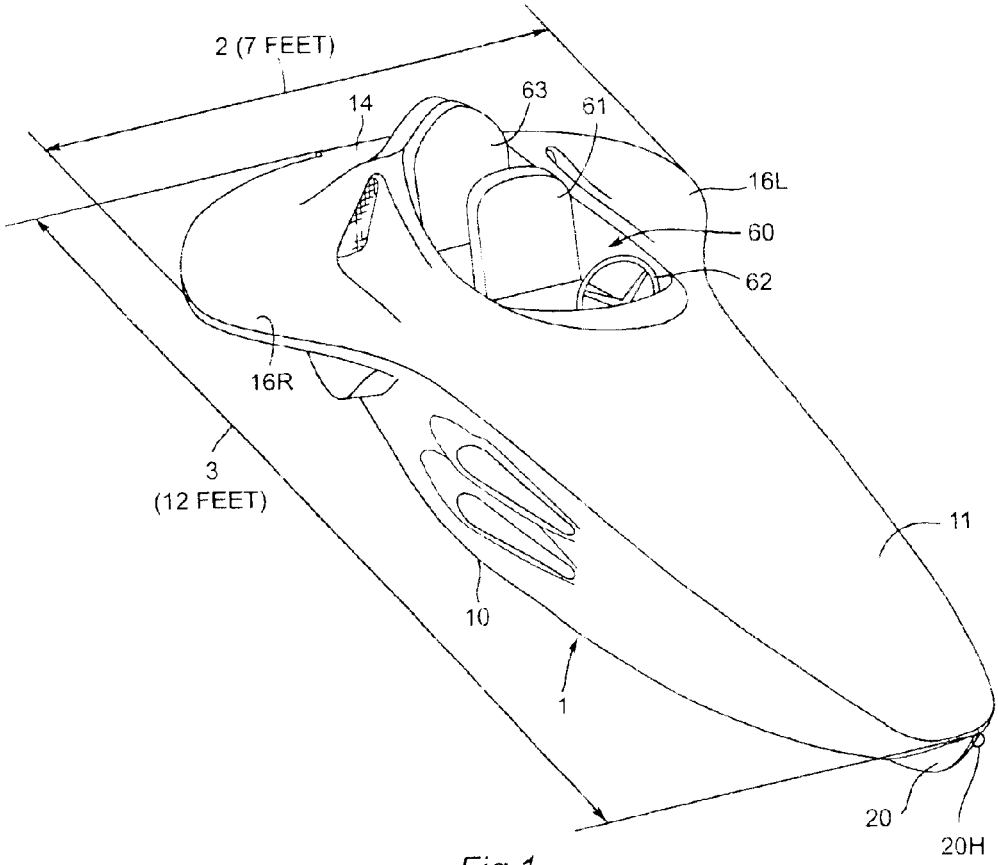
FIG. 1 is a three quarter front view of a preferred embodiment of the present invention out of the water.

A preferred embodiment of the present invention with two passenger seats is illustrated in FIGS. 1–8. Although FIGS. 1–8 are described in greater detail below, the following is a glossary of the elements identified in the Figures:

1 watercraft

2 width dimension of watercraft 1

3 length dimension of watercraft 1

5 water line

6 angle of attack of watercraft in water

10 hull

11 nose section of hull 10

12 mid-section removable canopy

13 transparent window

14 aft end-section of hull 10

15L left air intake

Figure 2:
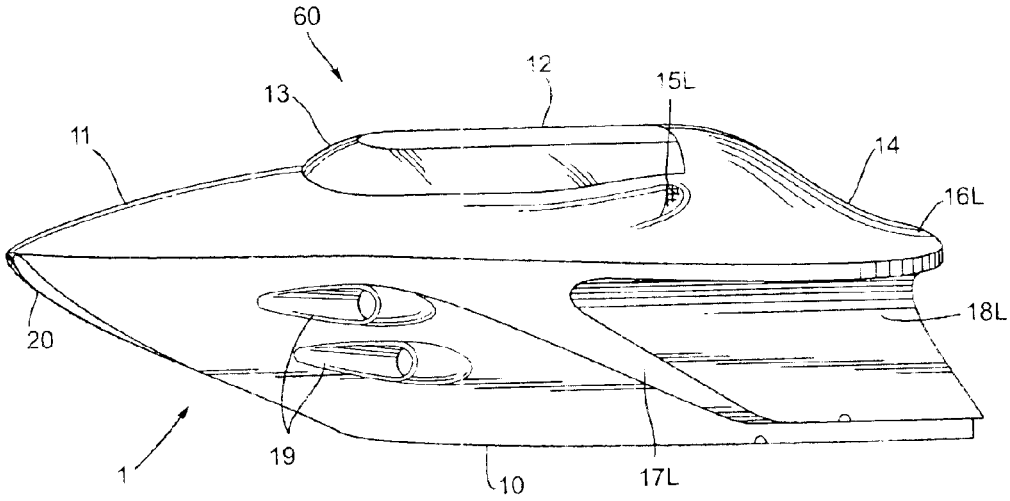
FIG. 2 is a left side view of a preferred embodiment of the present invention out of the water.
Figure 3:
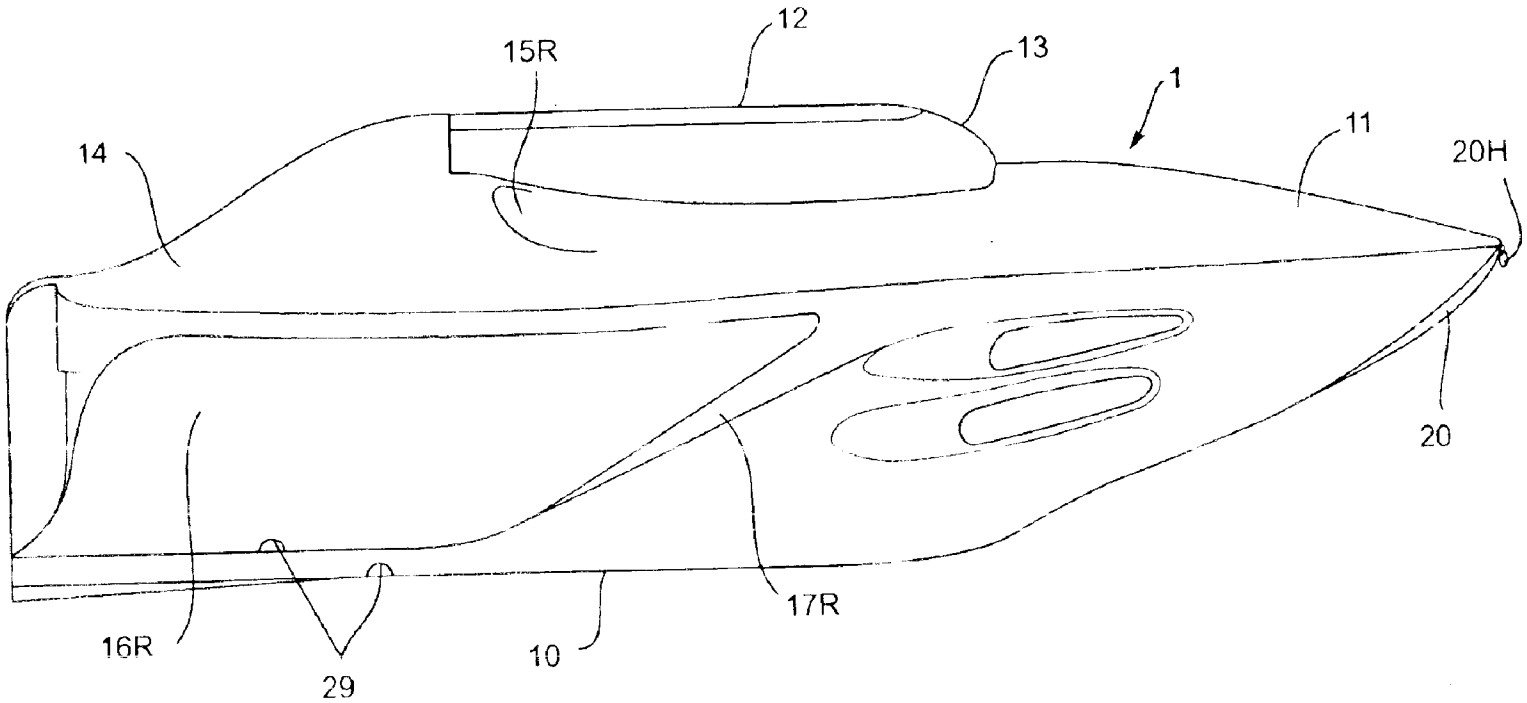
FIG. 3 is a right side view of a preferred embodiment of the present invention out of the water.

15R right air intake
16L left wing
16R right wing
17L left hull ramp
17R right hull ramp
18L left wing reverse curved surface
18R right wing reverse curved surface
19LH left high beam headlight
19LL left low beam headlight
19RH right high beam headlight
19RL right low beam headlight
20 keel
20H keel hook
21L left stabilizer
21R right stabilizer
22 tunnel
23 water intake ramp
28L left lift rail
28R right lift rail
29 water channel cutaways
30 ventral water inlet
40 jet pump
45 rudder
50 engine
55 shaft
60 passenger compartment
61 driver's passenger seat
62 steering wheel
63 second passenger seat
64 instrumentation panel FIG. 1 illustrates a three quarter front view of a preferred embodiment of a watercraft 1 according to the present invention out of the water. In FIG. 2, watercraft 1 is totally enclosed by hull 10 that extends longitudinally and has a forwardly tapering fore or nose section 11, mid-section canopy 12 with transparent window 13, and aft end-section 14 that extends laterally. In FIG. 1, mid-section canopy 12 (which can be detachable) and transparent window 13 have been removed. Passenger compartment 60 is formed inside of the mid-section of hull 10.

Figure 4:
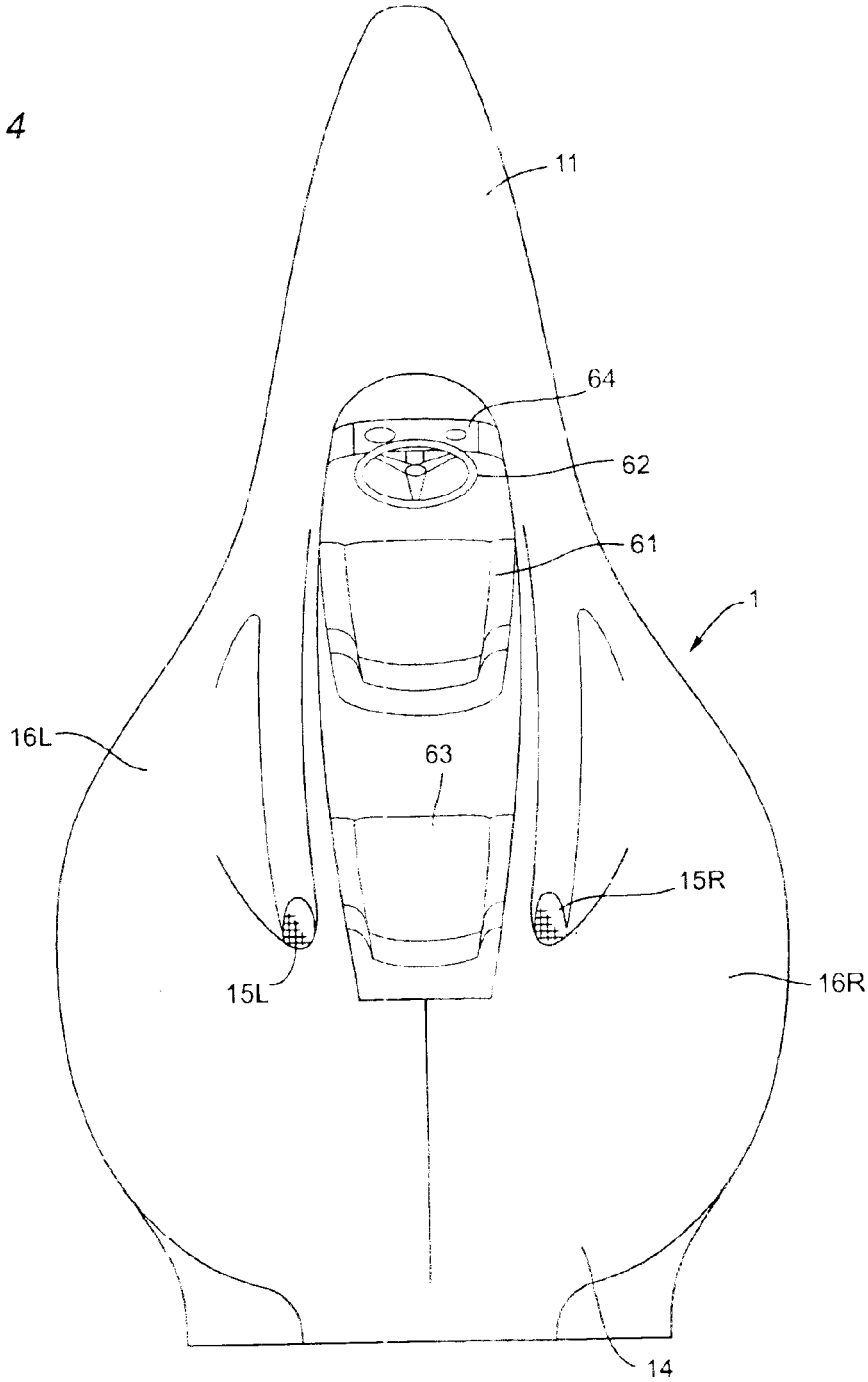
FIG. 4 is top planar view of a preferred embodiment of the present invention.
Figure 5:
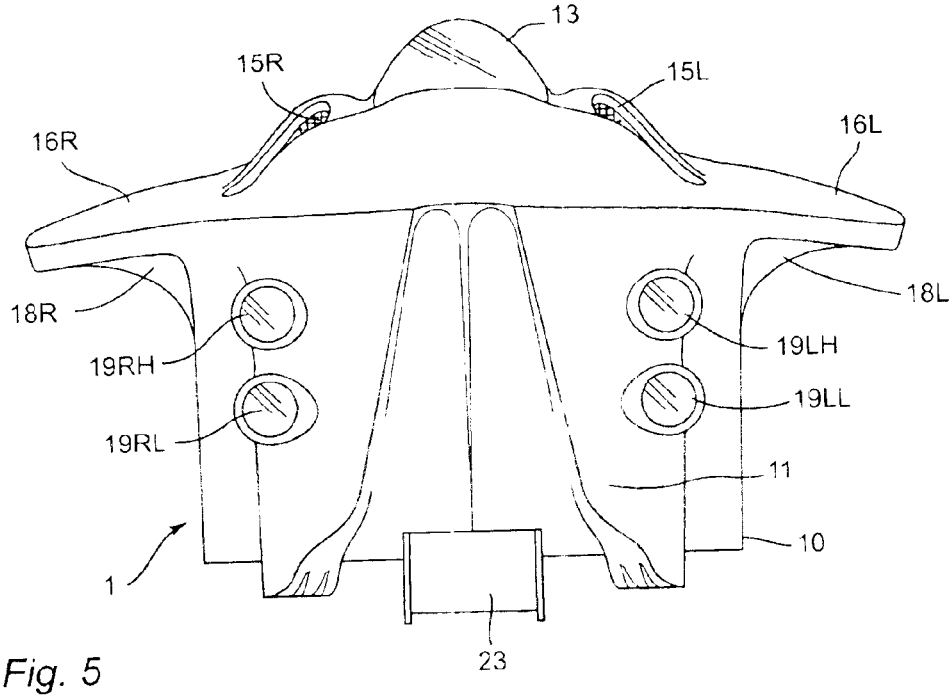
FIG. 5 is front view of a preferred embodiment of the present invention out of the water.
Figure 6:
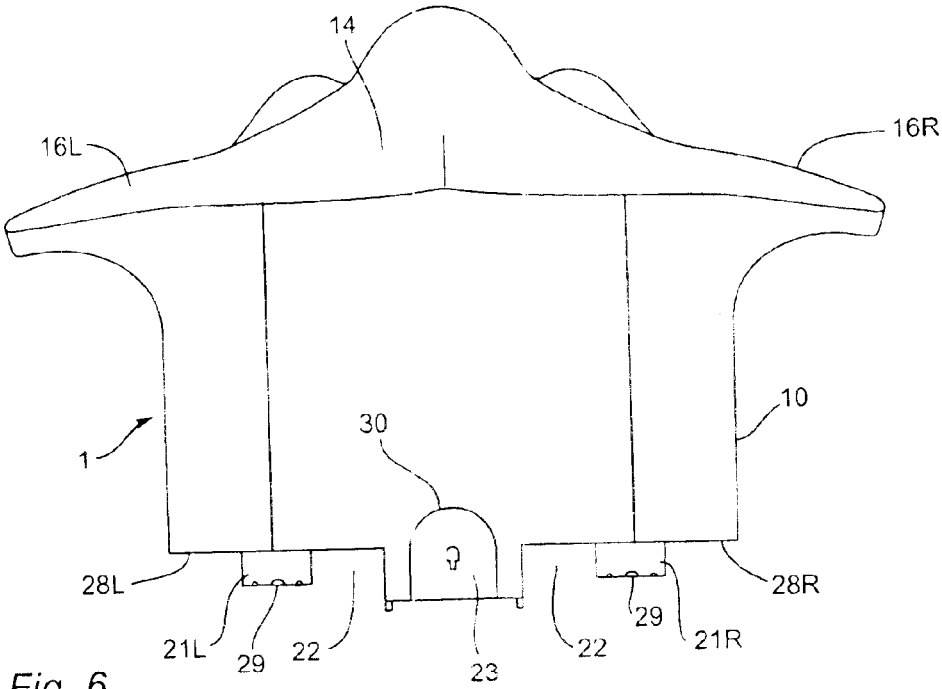
FIG. 6 is a rear view of a preferred embodiment of the present invention out of the water.
Figure 7:
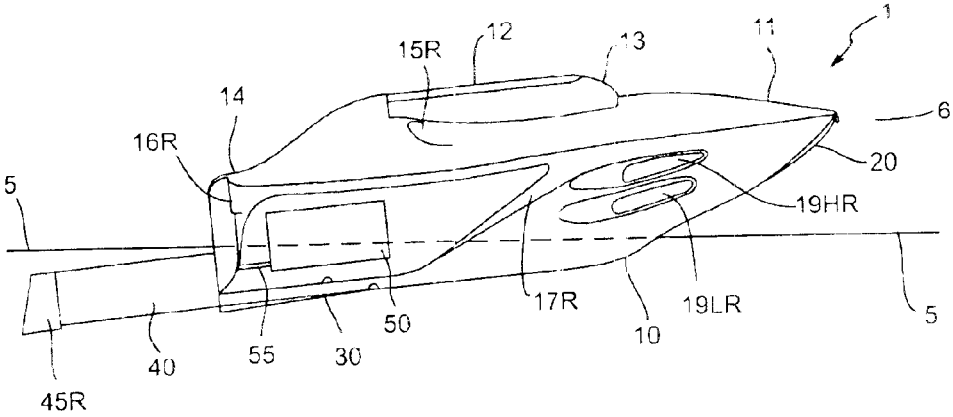
FIG. 7 is a right side view of a preferred embodiment of the present invention relative to water line 5 when the preferred embodiment is not moving.

As shown in FIGS. 4 and 5, flanking transparent window 13 and passenger compartment 60 are left and right air intakes 15L and 15R, and left and right wings 16L and 16R extend laterally therefrom and extend rearward to join aft end-section 14. Left and right hull ramps 17L and 17R run steeply downward from the leading edge of left and right wings 16L and 16R, extending therefrom to the bottom of hull 10. Left and right wing reverse curved surfaces 18L and 18R arc from beneath horizontal left and right wings 16L and 16R through 90 degrees to become vertical at the bottom of hull 10.

Left and right hull ramp 17L and 17R (shown in FIGS. 2 and 7) border left and right wing reverse curved surfaces 18L and 18R, respectively. Left and right high beam headlights 19LH and 19RH and left and right low beam headlights 19LL and 19RL project out from hull 10 as shown in FIG. 5.

Figure 8:
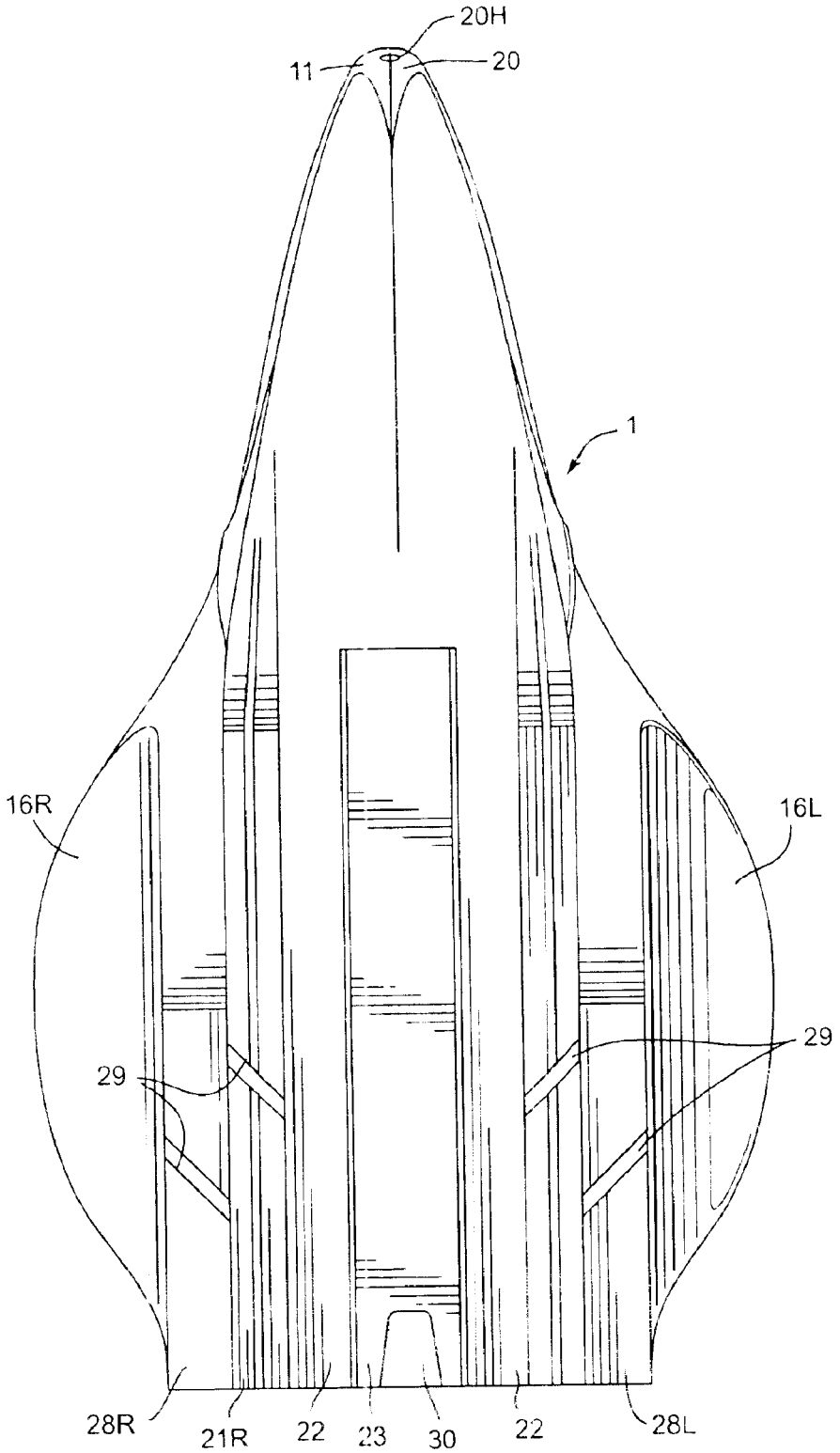
FIG. 8 is a bottom planar view of a preferred embodiment of the present invention out of the water.
Figure 9:
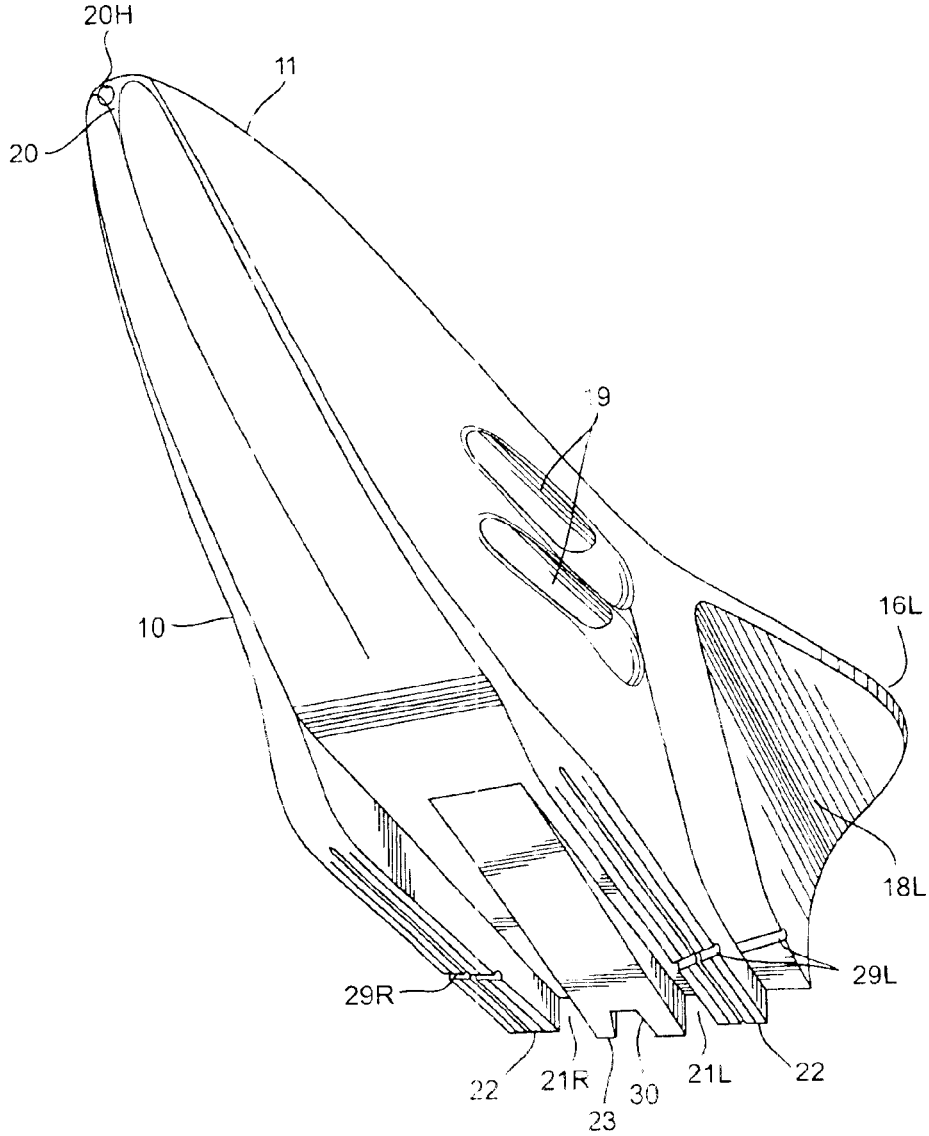
FIG. 9 is a bottom three quarter planar view of a preferred embodiment of the present invention out of the water.

FIGS. 8 and 9 show the bottom of hull 10. Keel 20, which can have a keel hook 20H, knifes downward from the tip of nose section 11 and stops at intake ramp 23 approximately halfway back from nose section 11. Left stabilizer 21L and right stabilizer 21R, which are parallel, begin aft of nose section 11 and run longitudinally approximately ¾ of the length of hull 10 so as to form a tunnel 22 beneath them that helps to compact air and create lift for watercraft 1. Ramp 23, located in tunnel 22 between left and right stabilizers 21L and 21R, creates a nozzle-like effect to accelerate water loading to jet pump 40 through ventral water inlet 30 when watercraft 1 is under power. Ventral water inlet 30 is located in, and is narrower than, intake ramp 23. Ramp 23 tapers downwardly from its forward-most beginning relative to nose section 11 and is located in tunnel 22 substantially back from the forward-most beginnings of the pair of stabilizers 21L and 21R relative to nose section 11, and is preferably located in the back longitudinal half of the watercraft relative to the nose section. Left lift rail 28L and right lift rail 28R, which are parallel, run longitudinally along the hull latitudinally outside of left and right stabilizers 21L and 21R. Water channel cutaways 29 are formed both in left and right stabilizers 21L and 21R and in left and right rails 28L and 28R; these cutaways run at an angle relative to a centerline as is clear from FIG. 8.

The outside surfaces of hull 10, the pair of wings 16L and 16R, the pair of ramps 17L and 17R, and the pair of left and right air intakes 15L and 15R are bilaterally symmetric with a center line running from nose section 11 through passenger compartment 60.

Watercraft 1 has a passenger compartment 60 that contains a driver's passenger seat 61, steering wheel 62 and instrumentation panel 64. In the preferred embodiment shown in FIGS. 1–9, a second passenger seat 63 is aligned behind drivers passenger seat 61. The passenger compartment 60 can be fitted with various electronic accessories and instruments, especially since the passenger compartment 60 can be kept totally dry during operation so as to avoid damage to equipment like a telephone or other electronic communications devices that would not be water resistant. A global positioning system can also be mounted within the passenger compartment, as could a depth finder or sonar system, both of which might be especially useful when the watercraft is used for fishing.

It is contemplated that watercraft 1 can be fitted with one or more accessory racks. For example, the watercraft can be mounted with multiple accessory racks to hold fishing gear, water skis or scuba equipment. An accessory compartment or container can also be mounted to such a rack. Such a compartment might be used to store food, drinks or bait, and might be a cooler, for example. It is especially preferred that accessory racks be mounted in the aft end-section of the watercraft, and the aft end-section can also be modified so as to allow for ease of entry into the watercraft from a person in the water, or for pulling something behind the watercraft, such as a person water skiing.

An engine compartment located in aft end-section 14 (not shown) houses an engine 50 that is connected to jet pump 40 by shaft 55. A rudder 45 provides steering in the event of power loss. Air intake to the engine is provided by either the left or the right air intakes 15L and 15R, while the other air intake provides ventilation. The engine is preferably a four stroke gas engine that runs on gasoline. Extra fuel and the fuel intake are also located in the engine compartment which is accessed by a removable opening (not shown).

In an especially preferred embodiment, the outside shell of hull 10 and left and right wings 16L and 16R are made of fiberglass and expansion foam is used to fill inner spaces and provide floatation to watercraft 1. In fact, it has been calculated that when the watercraft has a length dimension 3 of 12 feet and a width dimension 2 of seven feet, with a dry land weight of approximately 1200 pounds, expansion foam can provide sufficient buoyancy that the watercraft will remain afloat even if the hull is breached and the passenger compartment is completely filled with water.

When watercraft 1 is placed in water and is not given any power, left and right lift rails 28L and 28R will be below the water line 5, substantially all of left and right stabilizers 21L and 21R will be below water line 5 and left and right wings 16L and 16R will be above water line 5. As watercraft 1 is given power, left and right stabilizers 21L and 21R will begin to lift out of the water beginning at the fore section and traveling aft. When watercraft 1 is under full power, approximately ⅛ of left and right stabilizers 21L and 21R will be in the water, lift rails 28L and 28R will be out of the water and engine 50, driver's passenger seat 61 and second passenger seat 63 rest on the center of gravity of watercraft 1 at water line 5. Stabilizers 21L and 21R create a second lift to keep watercraft 1 riding in a straight direction under power, which increases stabilization of the watercraft.

The tops of the pair of wings 16L and 16R are curved in a configuration to give watercraft 1 top lift and the wings have a reverse curve on their bottom surface relative to water line 5 to push hull 10 upward and provide a faster plane for watercraft 1 to run on the pair of stabilizers 21L and 21R. Also, the entire deck of watercraft 1 is curved for top lift of air, like an airplane wing. The outside longitudinal edge surface of wings 16L and 16R are rounded to help stabilize turns of watercraft 1 under power.

In an especially preferred embodiment, the length of hull 1, which is shown as dimension 3 shown in FIG. 1, is approximately 12½ feet, while the width of watercraft 1, shown as dimension 2 in FIG. 1, is approximately 7 feet. In this especially preferred embodiment, whose dimensions are meant to be explanatory, but not limiting, the length of left and right stabilizers 21L and 21R is 86 inches, their width is 6 inches and their height is 6 inches from the aft of watercraft 1 until they start to curve upwardly to zero; tunnel 22 is approximately 20 inches wide; ramp 23 is approximately 10 inches wide and is seven inches deep at its most extreme depth; left and right lift rails 28L and 28R are 6 inches wide and 45 inches long from the back of the watercraft to where they start to curve up and then extend another 36 inches up to the mid-section; and the height of watercraft 1 at rest on land, to the topmost portion of canopy 12, is 51 inches.

Watercraft 1, when properly fitted, is exceptionally fast and stable, and can easily reach speeds of 80–90 miles per hour. Although watercraft 1 can be designed for use in racing, a slower propeller is contemplated for normal use to avoid excessive speed. When watercraft 1 is under full power, it can make sharp, quick turns without danger of flipping due to stability provided by wings 16L and 16R. Also, wings 16L and 16R serve to stabilize watercraft 1 to prevent it from becoming airborne, as is a common hazard to high-speed "cigarette" boats. Accordingly, watercraft 1 is an exceptionally fast, stable, versatile vehicle that is subject to many uses, including use as a fun personal watercraft that can be used in shallow water, fresh water, rivers and the ocean.

Watercraft 1 is unlike any other boat on the market today in every aspect. It improves on speed, performance, safety, and reliability while being environmentally friendly because its delta shape hull allows the integration of the best features from other boats into its new design.

The delta shape hull design makes watercraft 1, which will be sold under the trademark SKIMMER, virtually unsinkable; in fact, it has 75% more flotation than required by the stringent standards of the United States Coast Guard. This is achieved by the flotation foam in the wings and the nose which become a life preserver around people inside of the SKIMMMER watercraft. Self-bilging pumps allows a user to knock a 2 inch square hole in the SKIMMMER watercraft and still make it to shore.

The SKIMMMER watercraft offers an extensive list of features and benefits, in comparison to competing boats of size (less than 13 feet long), weight (a SKIMMER watercraft with the dimensions shown in FIG. 1 will weigh approximately 1200 pounds) and class, or other personal watercraft ("PWC") available on the market today, including the following:

Superior hull design: allows the SKIMMMER watercraft to hydroplane over the water, rather than to "push" the water down under the boat.

Brand-new paradigm, with an exciting new design, which will draw existing and new buyers.

Easier to control—user friendly. Cornering and turning are easier in the SKIMMMER watercraft—turns are flat, vs. a leaning turn in other small boats.

The SKIMMMER watercraft can be operated at night, with running lights (PWC are banned from operation after dark or before sunrise).

In the SKIMMMER watercraft, you float to a smooth stop, not an abrupt stop. In PWC, if you shut off the motor at a high rate of speed, e.g. 45 MPH, you can go flying over the handlebars. Note: the SKIMMMER watercraft has an emergency stop where the operator can throw the pump in reverse, and stop within 10 feet at 40 MPH.

In the SKIMMMER watercraft, because you are sitting in a passenger compartment that is akin to a cockpit, you cannot be easily tossed into the water (vs. other PWC, where passengers could easily slide off the seat and into the water).

The SKIMMMER watercraft has a lower center of gravity; therefore, it is not top-heavy, and more stable—it will not tilt over.

Performance capability is higher for the SKIMMMER watercraft than other PWC—the engine is behind the passenger, not under him or her.

Safety: The SKIMMMER watercraft has (a) less vibration, because the vessel is skimming, not bouncing; (b) a windshield, whereas other boats in the SKIMMER class are more akin to motorcycles with handlebars, with no way to mount a windshield. Additionally, the SKIMMMER watercraft can be fitted with a roll cage, either when it is originally sold or on the aftermarket.

Sound/Noise: The SKIMMMER watercraft can run exhaust down into the water, and basically eliminate noise. Also the SKIMMMER watercraft can mount noise resonators in the muffler.

Comfort: In the SKIMMMER watercraft you are sitting, not straddling; therefore, there is less fatigue for the rider, particularly over a ride of several hours.

Clothing gear: In the SKIMMMER watercraft, you do not need a wetsuit to operate it; in fact, one could ride in the SKIMMMER watercraft in formal wear and not ruin such clothes (when the canopy enclosing the passenger compartment is in place).

Easy maintenance: The SKIMMMER watercraft uses a gasoline-powered engine and does not need a gas and oil mixture like most PWC. The operator can gas up at a gas station, and put in oil every 6 months. You do not need a 2-stroke mechanic—instead, one can easily find parts at auto supply shops just like most boats and not the PWC on the market today.

Hull repair: The SKIMMMER watercraft has fiberglass hull which can be repaired on-site versus other boats in the PWC class which are made from composite plastic that cannot be repaired.

Maneuverability in shallow water: the SKIMMMER watercraft has more bottom surface area (approximately 3× the water surface area of other boats in the same class), therefore, more buoyancy than other boats in same class.

Instrumentation: The SKIMMMER watercraft can easily add safety and instrumentation, such as GPS and ship-to-shore radio.

The SKIMMMER watercraft is easier to get in and out of—step on wings (vs. other small boats in its class that require step on side, grip handle bars, and such boats can fall over.)

Canopy: In the SKIMMMER watercraft, one can install a Plexiglas canopy, or convertible ragtop, to keep out the sun. Also, air conditioning or a heater can easily be installed creating climate control in a boat under 13 feet.

Power: The SKIMMMER watercraft can use superior pumps because it can have a bigger nozzle of 4 inches versus the standard 2½ or 3 inch nozzle that is standard in other small boats in the SKIMMMER watercraft class or some PWC that do not have enough room.

Handicap accessibility: The SKIMMMER watercraft can cater to paraplegics with hand controls.

The SKIMMMER watercraft does not have a CDI-electronic ignition to create electrical problems in the water—which vibrates and burns up rapidly.

The SKIMMMER watercraft does not need a catalytic converter (used in other small boats in the same class, for noise control, which can clog up).

While the invention has been described herein with reference to certain preferred embodiments, those embodiments have been presented by way of example only, and not to limit the scope of the invention. Additional embodiments thereof will be obvious to those skilled in the art having the benefit of this detailed description. For example, a watercraft could be designed without departing from the spirit of the present invention in which the passenger compartment includes passenger seats in a side-by-side configuration, or multiple hulls with multiple passenger compartments that are linked together; alternatively, a much larger scaled version of the watercraft, up to over one hundred feet long with a much larger passenger cabin, could be scaled up from the watercraft described herein. In addition, because of the versatility of the watercraft described herein, such a watercraft could be adapted for special usage, such as for racing, for fishing, for water skiing, or for serving as a base for scuba diving. Furthermore, the watercraft of the present invention could be adapted for use as a fire-fighting watercraft by use of a quick connect or similar device to utilize the output of the jet pump to provide pressurized water for use in fighting fires. Another modification that can be made to a watercraft made in accordance with the present invention is to include a glass or similar type of bottom in the hull. Also, although watercraft 1 has been described as being driven by jet propulsion through use of a jet pump, the watercraft could be redesigned so as to be powered by one or more props and still take advantage of the stability and versatility that is obtained by use of the pair of stabilizers and the pair of wings. Further modifications are also possible in alternative embodiments without departing from the inventive concepts.

Accordingly, it will be apparent to those skilled in the art that still further changes and modifications in the actual concepts described herein can readily be made without departing from the spirit and scope of the disclosed inventions as defined by the following claims.

What is claimed is:

1. A watercraft, comprising:

a jet pump;

an engine connected to the jet pump by a shaft;

a hull that extends longitudinally, further comprising:

a forwardly tapering nose section with a keel that knifes downward from the tip of the nose section;

a pair of stabilizers that run longitudinally and spaced apart from each other that form a tunnel that runs substantially the length of the back half of the hull relative to the nose section;

a water intake ramp located in the tunnel substantially back from the forward-most beginnings of the pair of stabilizers relative to the nose section, the ramp tapering downwardly from its forward-most beginning relative to the nose section;

a ventral water inlet located in the intake ramp for supplying water to the jet pump, the intake ramp providing loading to the jet pump; and a mid-section passenger compartment formed within the hull with at least one passenger seat and a steering control mechanism;

an aft end-section that extends laterally, the engine being located in the aft end-section;

at least one air intake flanking the mid-section passenger compartment;

a pair of wings flanking the passenger compartment and extending laterally therefrom and extending rearward to join the aft end-section, there being a left wing and a right wing;

wherein a pair of hull ramps runs steeply downward from the leading edge of each of the pair of wings, extending therefrom to the bottom of the hull, there being a left hull ramp and a right hull ramp;

wherein a pair of air scoops flanks each side of the passenger compartment from which the pair of wings extend laterally therefrom, thereby forming a left air scoop and a right air scoop, and one of the pair of air scoops comprises the at least one air intake, the pair of air scoops being located above the pair of wings while the pair of hull ramps are located below the pair of wings; and wherein the hull, the pair of wings, the pair of hull ramps, and the pair of air scoops are bilaterally symmetric with a centerline running through the nose section and the passenger compartment.

2. The watercraft of claim 1, further comprising:

a rudder connected to the jet pump.

3. The watercraft of claim 1, wherein the forward-most beginnings of the pair of stabilizers relative to the nose section ride above the surface of the water when the watercraft is under power and the watercraft rides on the pair of stabilizers.

4. The watercraft of claim 1, wherein the pair of wings ride above the surface of the water when the watercraft is under power.

5. The watercraft of claim 1, wherein the watercraft is steered under power by water-jet propulsion.

6. The watercraft of claim 1, wherein the intake ramp is located in the back longitudinal half of the watercraft relative to the nose section.

7. The watercraft of claim 1, wherein the pair of wings have a reverse curve on their bottom surface relative to the surface of the water to push the hull upward and provide a faster plane for the watercraft to run on the pair of stabilizers.

8. The watercraft of claim 1, wherein the tops of the pair of wings a re curved in a configuration to give the watercraft top lift.

9. The watercraft of claim 1, wherein the at least one air intake comprises a pair of air intakes, one being located on each side of the passenger compartment, a first air intake being for air intake to the engine, a second air intake being for ventilation.

10. The watercraft of claim 1, wherein the engine rests on the center of gravity of the watercraft at the water line under power.

11. The watercraft of claim 1, wherein a driver's passenger seat located within the passenger compartment rests on the center of gravity of the watercraft at the water line under power.

12. The watercraft of claim 1, wherein the intake ramp is latitudinally wider than the ventral water inlet.

13. The watercraft of claim 1, wherein the intake ramp creates a nozzle-like effect to accelerate water loading to the jet pump when the watercraft is under power.

14. The watercraft of claim 1, further comprising:

a pair of headlamps that project frontward out of the hull.

15. The watercraft of claim 1, further comprising:

at least one accessory rack mounted to the aft end-section.

16. The watercraft of claim 1, further comprising a mid-section canopy.

17. The watercraft of claim 16, wherein the mid-section canopy has a transparent window.

18. The watercraft of claim 16, wherein the mid-section canopy is detachable from the watercraft.

19. The watercraft of claim 16, wherein the mid-section canopy and the hull totally enclose the passenger compartment.

20. The watercraft of claim 1, wherein the passenger compartment is configured with only one passenger seat.

21. The watercraft of claim 1, wherein the passenger compartment is configured with a plurality of passenger seats.

22. The watercraft of claim 21, wherein the passenger compartment has two passenger seats and the second passenger seat is aligned longitudinally behind the first passenger seat relative to the nose section.

23. The watercraft of claim 1, wherein the watercraft is steered by a steering wheel located within the passenger compartment.

24. The watercraft of claim 1, further comprising:

a global positioning system with a display mounted within the passenger compartment.

25. The watercraft of claim 1, further comprising:

a depth finder with a display mounted within the passenger compartment.

26. The watercraft of claim 1, further comprising:

an electronic communications device with an input device mounted within the passenger compartment.

27. The watercraft of claim 1, wherein the watercraft is under sixteen feet in length.

* * * * *